United States Patent [19]

Orii et al.

[11] Patent Number: 4,981,096

[45] Date of Patent: Jan. 1, 1991

[54] ELECTRONICALLY CONTROLLED SEWING MACHINE

[75] Inventors: Akira Orii; Yoshiaki Sakata, both of Tokyo, Japan

[73] Assignee: Janome Sewing Machine Co., Ltd., Tokyo, Japan

[21] Appl. No.: 518,115

[22] Filed: May 3, 1990

[30] Foreign Application Priority Data

May 12, 1989 [JP] Japan ..... 1-117484

[51] Int. Cl.[5] ..... D05B 3/02

[52] U.S. Cl. ..... 112/453; 112/220; 112/275; 318/432; 318/434; 318/799; 318/476

[58] Field of Search ..... 112/453, 220, 277, 275, 112/121.11; 318/476, 685, 432, 434, 798, 799, 806

[56] References Cited

U.S. PATENT DOCUMENTS 4,315,472 2/1982 Makabe et al. ..... 112/453
4,322,668 3/1982 Trussler et al. ..... 318/476 X
4,677,925 7/1987 Murakami et al. ..... 112/445 X

*Primary Examiner*—Peter Nerbun

*Attorney, Agent, or Firm*—Michael J. Striker

[57] ABSTRACT

An electronically controlled sewing machine, comprises a current detecting device for detecting a value of current flowing through a stepping motor that drives a machine part and current setting means for setting a value of current to be applied to the stepping motor. The sewing machine further includes a control device (CPU) for storing a plurality of different values of currents to be applied to the stepping motor and driving the stepping motor until the stepping motor passes through an initial position thereof. The control device stops the stepping motor at a predetermined angular position thereof spaced from the initial position. The control device supplies the different values of currents to the stepping motor in a predetermined sequence from a smallest value to a larger value of current under a predetermined program to drive the stepping motor until the stepping motor reaches the initial position thereof. The control device further determines a current value that has driven the stepping motor to the initial position at a last step of current supply to establish a basis for setting a current value which is specific to the stepping motor.

1 Claim, 2 Drawing Sheets

ELECTRONICALLY CONTROLLED SEWING MACHINE

FIELD OF THE INVENTION

The present invention relates to a sewing machine with an electronically controlled sewing machine, and more particularly to the initial setting of a current value applied to a stepping motor for controlling needle positions and/or the initial setting of a current value applied to a stepping motor for controlling feeding amounts of a fabric to be sewn.

BACKGROUND OF THE INVENTION

Generally an electronically controlled sewing machine has a stepping motor for controlling the positions of a needle vertically reciprocating and laterally swingable and another stepping motor for controlling the feeding amounts of a fabric to be sewn.

So far, each of the stepping motors had a predetermined fixed current value applied thereto, and the fixed current value was required to be a comparatively higher than necessary. This is because the component parts of the sewing machine operatively connected between the stepping motor and the needle or a feed dog generally have dimensional errors which may be caused during the production though the errors are within a tolerable range. The production errors may be further caused in control circuits, stepping motors, stepping motor drive circuits, current setting circuits, etc. The loads and errors may be further variable by the change of environmental temperatures. Generally it is required that the set current value is sufficient enough to move the loads even if the components having the largest errors are combined.

With a current value comparatively higher than necessary, applied to the stepping motor according to the prior art, the stepping motor is provided with a sufficient torque to move a prescribed load, but has an electric current more than necessary flowing through the coil of the motor. As a result, a stepping motor drive device is under a heavy load and is heated up together with the stepping motor.

SUMMARY OF THE INVENTION

It is an object of the invention to eliminate the defects and disadvantages of the conventional electronically controlled sewing machines having a stepping motor for controlling the positions of a vertically reciprocating and laterally swingable needle and another stepping motor for controlling the feeding amounts of a fabric to be sewn. The object of the invention is achieved by providing a sewing machine which substantially comprises current detecting means for detecting the values of currents flowing through the coils of the stepping motors respectively, current setting means for setting a value of current to be supplied to the stepping motors, and a central processing unit having a plurality of different values of currents to be supplied to the stepping motors, the central processing unit supplying the different values of currents to the stepping motors in a predetermined sequence from the smallest to larger values of currents to drive the stepping motors until the stepping motors come to predetermined initial positions thereof respectively. Thus a current value that has driven the stepping motors to the respective initial positions at the last step is employed as a basis for determining a current value to be specifically applied to the stepping motors.

With the current value specifically applied to the stepping motors, it is apparent that the overheat of the stepping motors which may otherwise be caused will be prevented, and the stepping motors will be smoothly driven without producing noises. Further, the stepping motor drive device will be prevented from being subjected to heavy loads which may otherwise be caused, and from being overheated.

If the stepping motors will not reach the respective initial positions when predetermined values of currents are applied thereto a warning may be made in a display for stitch patterns to be sewn to indicate that something is wrong with the stepping motor drive circuit or the loads in connection with the stepping motors.

The invention both as to its construction so to its mode of operation, together with additional objects and advantages thereof, will be best understood from the following detailed description of the preferred embodiment when read with reference to the accompanying drawings.

DETAILED DESCRIPTION OF THE INVENTION

Figure 1:
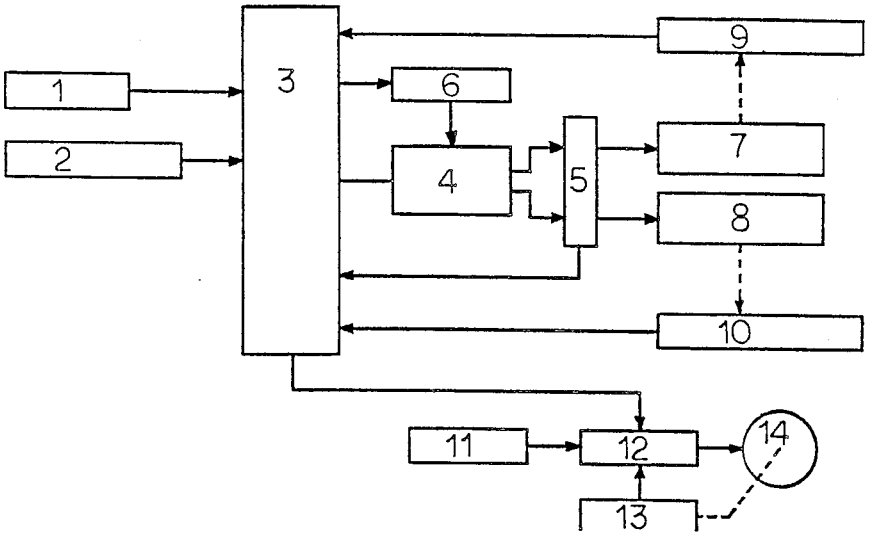
FIG. 1 is a block diagram showing a control system of the invention.

The invention will be explained with reference to a preferred embodiment shown in the drawings:

In FIG. 1, a pattern data memory 2 has data stored therein for a plurality of different patterns which are optionally selected by selective operation of a pattern selecting device 1. A central processing unit (CPU) 3 in response to operation of the pattern selecting device 1, reads out a pattern to be stitched and outputs control signals to a stepping motor drive device 4 and a feed-back speed control device including a machine drive motor 14, a speed setting device 11, a speed control device 12 and a speed detecting device 13, to thereby provide for forming the selected patterns.

The feed-back speed control device does not form a part of the invention, and is therefore not explained herein.

The current detecting device 5 is employed to detect a current amount supplied to a stepping motor 7 for controlling needle positions and to another stepping motor 8 for controlling fabric feeding amounts.

The current setting device 6 is operable to set a current amount to the stepping motor drive device 4 on the basis of the control signal from the CPU.

A sensor 9 is operable to detect an initial position of the stepping motor 7 for controlling the needle positions, and a sensor 10 is operable to detect an initial position of the stepping motor 8 for controlling the fabric feeding amounts.

The current setting sequence is as follows:

At the time to supply a power source, the load torque of the stepping motors are indefinite in each of the sewing machines due to the production errors of the constituent parts thereof, and therefore the current values are indefinite to sufficiently operate the stepping motors in each of the sewing machines.

Figure 2:
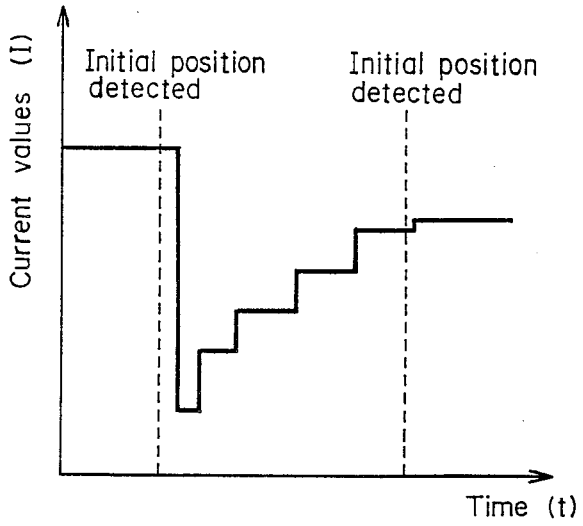
FIG. 2 is a diagram showing a rise of electric current values applied to a stepping motor from a time when a power source is applied to a sewing machine to a time when an electric current value is set to the stepping motor.
Figure 3:
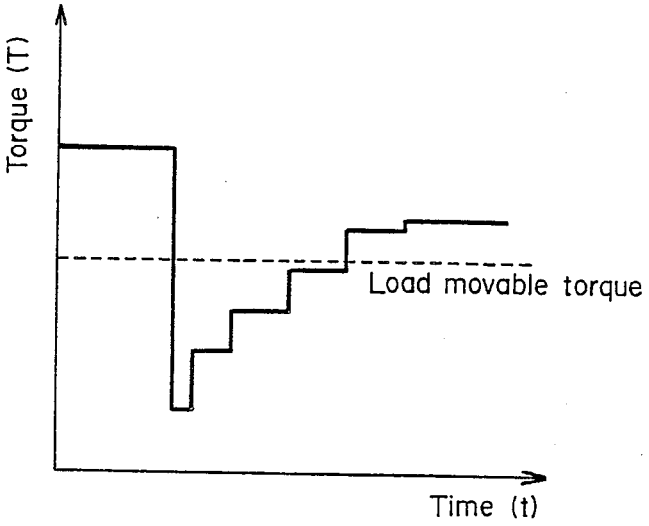
FIG. 3 is a diagram showing a rise of the stepping motor torque from the time when the power source is applied to the sewing machine to the time when the electric current value is set to the stepping motor.

Further in reference to FIGS. 2 and 3, the current values for the stepping motor are automatically determined under a control of programs stored in the central processing unit 3.

First of all, when the machine needle is not at a position where the position of the laterally swingable needle may be controlled, that is, at the upper dead position thereof, the machine drive motor 14 is driven until the needle comes to the needle controllable position.

Subsequently, the stepping motor 7 is driven with a maximum possible current value until the sensor 9 detects that the stepping motor comes to the initial position thereof. Then the stepping motor 7 is stopped at a rotation phase displaced from the initial position, that is, displaced several steps, 8 steps for example, corresponding to one cycle of the stepping motor.

Subsequently the stepping motor is driven toward the initial position thereof with a minimum possible current value. If the stepping motor is not driven to the initial position with this minimum current value applied thereto, one step larger current value as shown in FIG. 2 is applied to the stepping motor to further drive the same to the initial position with so much additional torque accordingly, as shown in FIG. 3.

A predetermined number of different current values from minimum to maximum stored in the central processing unit 3 are sequentially applied to the stepping motor until the stepping motor reaches the initial position thereof where the current value provides an increased torque which is beyond a load movable torque as shown in FIG. 3.

This last current value together with an additional current value provided in consideration of a variation of load and of environmental temperature, etc., is determined as a current value specifically set to the stepping motor.

In the above mentioned process for setting the current value which is specific to the stepping motor, if the stepping motor is not driven to the initial position thereof while a maximum one of the prepared current values is applied to the motor, a warning may be made in a display for stitch patterns to indicate that something is wrong with the stepping motor control circuit, the loads and the like between the stepping motor and the needle.

With the same process applied to another stepping motor 8 for controlling the fabric feeding amounts, a specific current value may be set to this stepping motor.

While the invention has been illustrated and described as embodied in an electronically controlled sewing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. An electronically controlled sewing machine, comprising at least one stepping motor for controlling displacement of a sewing machine part; a sensor for detecting an initial position of said stepping motor; current detecting means for detecting a value of current flowing through the stepping motor; current setting means for setting a value of current to be applied to the stepping motor; and control means (CPU) for storing a plurality of different values of currents to be applied to the stepping motor, for driving the stepping motor until the stepping motor passes through an initial position thereof, and for stopping the stepping motor at a predetermined angular position thereof spaced from the initial position, said control means supplying said different values of currents to the stepping motor in a predetermined sequence from a smallest value to a larger value of current under a predetermined program to drive the stepping motor until the stepping motor reaches the initial position thereof, said control means further determining a current value that has driven the stepping motor to the initial position at a last step of current supply to establish a basis for setting a current value which is specific to the stepping motor.

* * * * *